US011197526B2

(12) United States Patent
White

(10) Patent No.: US 11,197,526 B2
(45) Date of Patent: Dec. 14, 2021

(54) HAIR PAINTING BOARD AND METHOD THEREFOR

(71) Applicant: Todd White, Las Vegas, NV (US)

(72) Inventor: Todd White, Las Vegas, NV (US)

( * ) Notice: Subject to any disclaimer, the term of this patent is extended or adjusted under 35 U.S.C. 154(b) by 815 days.

(21) Appl. No.: 15/642,310

(22) Filed: Jul. 5, 2017

(65) Prior Publication Data

US 2018/0042355 A1 Feb. 15, 2018

Related U.S. Application Data

(60) Provisional application No. 62/373,294, filed on Aug. 10, 2016.

(51) Int. Cl.
*A45D 19/00* (2006.01)

(52) U.S. Cl.
CPC ..... *A45D 19/016* (2021.01); *A45D 19/0066* (2021.01); *A45D 19/0083* (2021.01); *A45D 2019/0033* (2013.01)

(58) Field of Classification Search
CPC ..... A45D 19/0016; A45D 19/0025; A45D 44/002; A45D 44/12; A45D 44/10; A45D 44/08; A45D 27/42; A45D 2019/0033; A45D 2019/0066; A45D 2019/0075; A45D 2019/0083; A45D 19/016; A45D 7/045; A45D 7/065
USPC ..... 132/221, 270, 319; D28/7
See application file for complete search history.

(56) References Cited

U.S. PATENT DOCUMENTS

D209,896 S 1/1968 Anderson
3,786,819 A * 1/1974 Cantrell ..... A45D 19/0016 132/270
D244,880 S 6/1977 Terry
4,144,897 A * 3/1979 Mosz ..... A45D 19/0008 132/270
D258,322 S 2/1981 Buhler
4,880,019 A * 11/1989 Roubo ..... A45D 19/0016 132/270
D306,921 S 3/1990 Pettnelli
D321,268 S 10/1991 Nix
5,146,937 A * 9/1992 Lefebvre ..... A45D 19/0025 132/208
D331,820 S 12/1992 Scanlon
D335,196 S 4/1993 Lamb
(Continued)

FOREIGN PATENT DOCUMENTS

DM 048579 7/1999

OTHER PUBLICATIONS

Foley, Lorriane, H2D Balayage Comb, Nov. 30, 2015 (retrieved Oct. 18, 2017 on youtube.com), https://www.youtube.com/watch?v=eqllw4U5piw.

*Primary Examiner* — Tatiana L Nobrega
(74) *Attorney, Agent, or Firm* — Lightbulb IP, LLC

(57) ABSTRACT

A hair painting board fosters application of coloring and other hair treatments in an efficient manner. The hair painting board has a curved body to conform to the shape a client's scalp. A wider end of the hair painting board provides the option to a hair stylist to select a variety of hair strands from various areas of the scalp and apply treatment thereto quickly and efficiently. A narrower end is useful for application of treatment at smaller areas of the scalp. One or more notches in the curved body aid in grasping and manipulating the hair painting board.

15 Claims, 4 Drawing Sheets

(56) References Cited

U.S. PATENT DOCUMENTS

| | | | | |
|---|---|---|---|---|
| D335,937 | S | 5/1993 | Owens | |
| D349,362 | S | 8/1994 | Russell | |
| 6,237,149 | B1 | 5/2001 | MacDonald | |
| 6,305,389 | B1 | 10/2001 | Bakken | |
| D528,248 | S * | 9/2006 | Kalichman | D28/10 |
| D583,514 | S | 12/2008 | Mason | |
| 7,628,160 | B2 | 12/2009 | Winup | |
| D630,385 | S | 1/2011 | Bishop | |
| 8,132,576 | B1 | 3/2012 | Trottier | |
| D660,522 | S | 5/2012 | Juhlin | |
| D662,261 | S | 6/2012 | Klotz | |
| D677,008 | S | 2/2013 | Klotz | |
| D677,435 | S | 3/2013 | Klotz | |
| D683,078 | S | 5/2013 | Klotz | |
| D712,092 | S | 8/2014 | Watabe | |
| 8,939,160 | B2 | 1/2015 | Falcucci | |
| D741,543 | S * | 10/2015 | Rufo | D28/7 |
| D758,009 | S | 5/2016 | Berkos | |
| D781,507 | S | 3/2017 | Huh | |
| D789,605 | S | 6/2017 | Caudillo | |
| D814,699 | S * | 4/2018 | White | D28/10 |
| D835,339 | S * | 12/2018 | Briscolini | D28/7 |
| D840,592 | S * | 2/2019 | Briscolini | D28/30 |
| 2005/0224090 | A1* | 10/2005 | Rizzo | A45D 19/016 132/222 |
| 2007/0089759 | A1* | 4/2007 | Winterstein | A45D 19/0025 132/208 |
| 2013/0087164 | A1* | 4/2013 | Thomas | A45D 44/00 132/200 |
| 2015/0107615 | A1* | 4/2015 | Houlder | A45D 29/22 132/73 |
| 2016/0088882 | A1 | 3/2016 | Behrend | |
| 2016/0166914 | A1 | 6/2016 | Heim | |
| 2016/0278499 | A1* | 9/2016 | Kingston | A45D 19/016 |
| 2019/0037996 | A1* | 2/2019 | Azuma | A45D 29/00 |
| 2019/0261758 | A1* | 8/2019 | Seminara | A45D 19/00 |

* cited by examiner

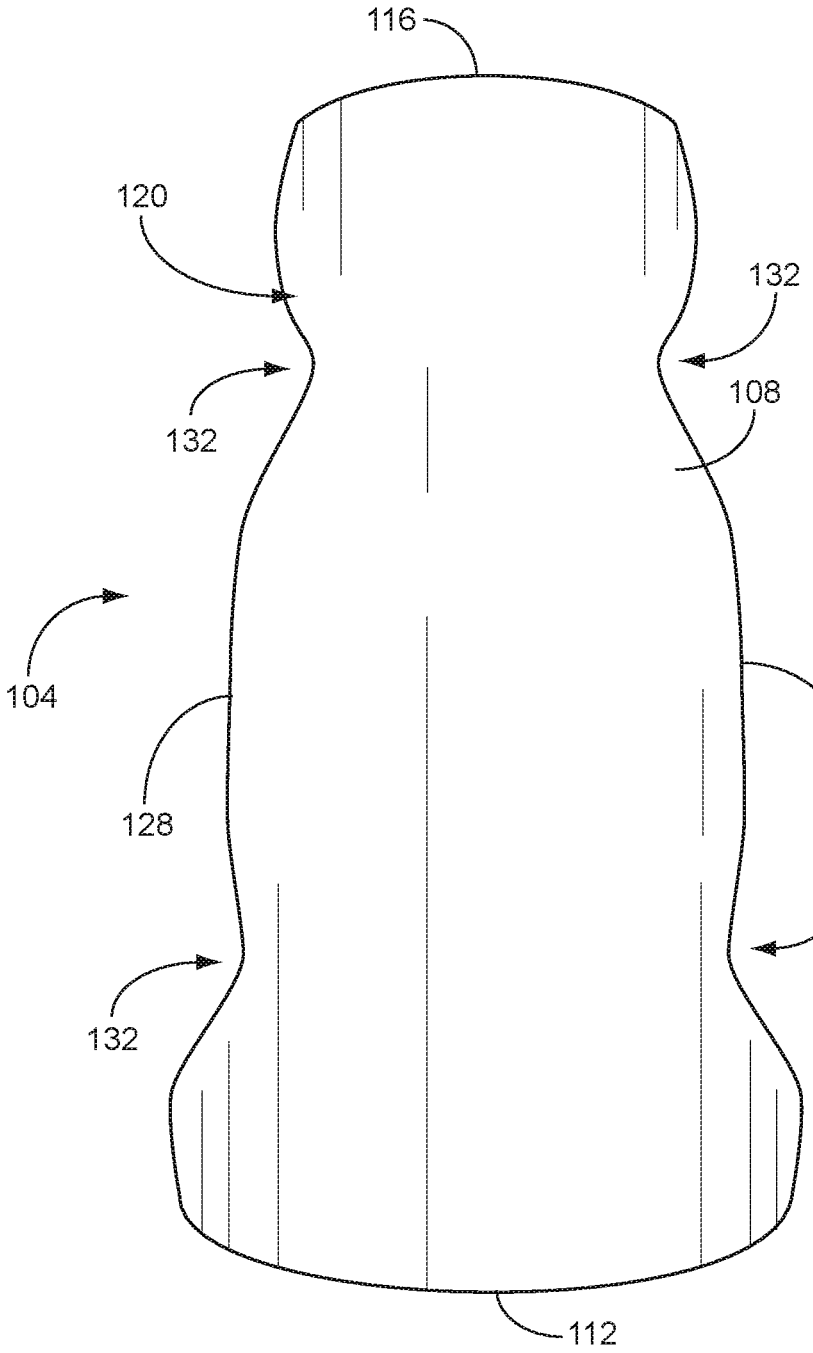
FIG. 1
FIG. 2
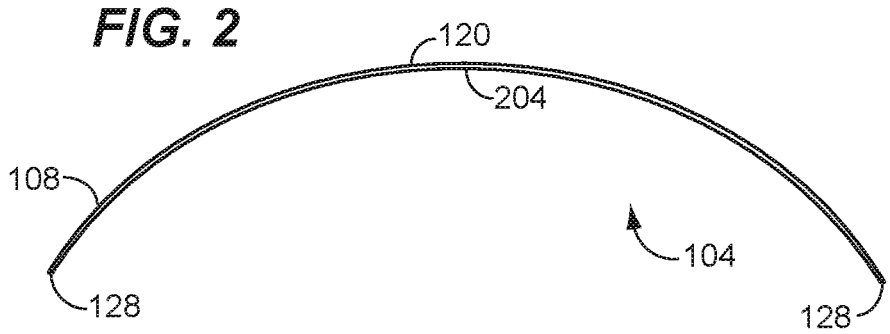

HAIR PAINTING BOARD AND METHOD THEREFOR

CROSS-REFERENCE TO RELATED APPLICATION

This application claims priority to U.S. Provisional Patent Application No. 62/373,294, filed Aug. 10, 2016.

BACKGROUND OF THE INVENTION

Field of the Invention

The invention relates to hair coloring and in particular to a hair painting board and methods therefor.

Related Art

A variety of hair coloring treatments are available. One commonly desired treatment is highlighting. Traditional balayage or foil highlighting can be performed manually or with the aid of hair coloring implements.

From the discussion that follows, it will become apparent that the present invention addresses the deficiencies associated with the prior art while providing numerous additional advantages and benefits not contemplated or possible with prior art constructions.

SUMMARY OF THE INVENTION

A hair painting board is disclosed herein. The hair painting board aids hair stylists in applying hair treatments, such as coloring. The hair painting board has a unique curved shape for treating various areas of a client's scalp. In addition, the hair painting board may be flexible and can be modified to conform to various curvatures. The hair painting board also has a contoured shape to aid in grasping and manipulating the hair painting board during use.

Various embodiments of the hair painting board and methods for the same are disclosed herein. For example, in one exemplary embodiment the hair painting board comprises a curved body having a wide end and a narrower end, one or more contoured sides comprising one or more notches, a concave top surface, and a convex bottom surface. The curved body is formed from a resilient planar material;

An optional handle may be affixed at the convex bottom surface to aid in holding or grasping the hair painting board. The concave top surface may have one or more guides affixed thereon. Such guides may be used to guide placement of coverings, hair or other implements. In addition, a guide may provide instructional or other informational material. The curve of the curved body may be adjusted after heating the resilient planar material.

In another exemplary embodiment, a hair painting board comprises a curved body having a first end and a second end, one or more sides comprising one or more notched portions, a concave top surface, and a convex bottom surface. The first end is wider than the second end to cause the curved body to be tapered.

Similar to the above embodiments, a handle may be at the bottom surface, and the concave top surface may have one or more guides affixed thereon. Likewise, a curve of the curved body may be adjusted after heating the curved body. The curved body may be formed from a resilient material.

In another exemplary embodiment, a method for applying hair treatments using a hair painting board is disclosed, with such method comprising parting hair at a selected area of a scalp to form a part and holding a hair painting board at one or more notched portions at one or more sides of the hair painting board. The hair painting board comprises a tapered curved body with a first end and a second end and formed from a resilient planar material.

The exemplary method also includes engaging the scalp at the part with the first end of the hair painting board, placing one or more strands of hair on a top surface of the hair painting board, and applying on or more compounds to the strands. A covering may be applied to the first end of the hair painting board before engaging the scalp at the part.

A second part may be formed in the hair and the scalp may be engaged at the second part with the second end of the hair painting board to treat additional strands of hair. The second part may be at a narrower portion of the scalp, which will typically be more easily engaged with a second end or narrower end of the hair painting board.

The hair painting board may optionally be held or grasped at a handle extending from a bottom end of the hair painting board. In addition, a curve of the tapered curved body may be adjusted by heating the resilient planar material.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 1 is a top view of an exemplary hair painting board;

FIG. 2 is a cross sectional view of an exemplary hair painting board;

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The hair painting board herein provides ample surface area for hair painting techniques. In addition, the hair painting board allows a hair stylist or other user to improve the quality and consistency of treatments, while also increasing the efficiency of applying such treatments. The hair painting board may also be customized in one or more embodiments.

FIG. 1 is a top view of an exemplary hair painting board 104. As can be seen, a hair painting board 104 may comprise a curved body 108 having a front end 112 and a rear end 116. The curved body 108 may be curved along its lateral axis to form a concave shape, such as shown in the cross sectional view of FIG. 2. The concave shape allows the hair painting board to conform to a portion of a client's scalp.

In one or more embodiments, the curved body 108 will be formed from a planar structure, such as shown. Typically, the curved body 108 will be formed from a waterproof material, such as plastic. It is contemplated that the curve of the curved body 108 may be modifiable by softening the curved body with heat, altering the curve and allowing the curved body to cool/harden in the shape of the altered curve. The curved body 108 may be formed from thermoformable plastic or other material in such case. It is contemplated that a hair dryer may be used to heat the hair painting board.

Figure 5:
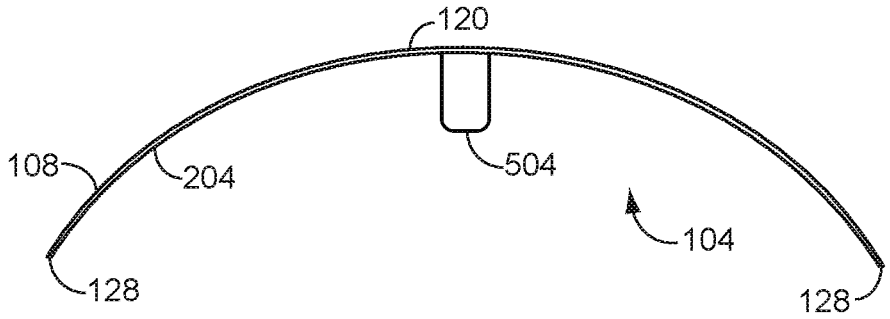
FIG. 5 is a cross sectional view of an exemplary hair painting board.

The curved body 108 comprises a top surface 120 and a bottom surface 204. As will be described further below, the top surface 120 may be used to perform hair painting techniques. It is contemplated that various colors, designs, graphics or the like may be printed on or otherwise applied to a top surface 120. In one or more embodiments, a guide may be printed on a top surface 120, such as to aid in placement of coverings, hair or other implements. It is contemplated that a handle 504 for grasping the hair painting board 104, such as shown in FIG. 5, may be attached to a bottom surface 124 in some embodiments.

One end of the hair painting board 104 may be wider than the other end. As can be seen from FIG. 1, the hair painting board 104 has a wider front end 112 as compared to its rear end 116. In other words, the hair painting board's curved body 108 may taper from its front end 112 to its rear end 116 in one or more embodiments.

As will be described further below, the wider front end 112 of the hair painting board 104 provides an increased surface area upon which hair painting can occur. In addition, the width of the front end 112 allows the hair painting board 104 to conform to an increased portion of a client's scalp, allowing the hair stylist to treat more hair at one time and complete their service in significantly less time. In one or more embodiments, the front end 112 may extend from ear to ear. The narrower rear end 116 also provides a surface area upon which hair painting can occur. The reduced width of the rear end 116 is beneficial in that it permits the hair painting board 104 to conform to smaller portions of a client's scalp, such as when treatment of particular strands of hair is desired.

Figure 3:
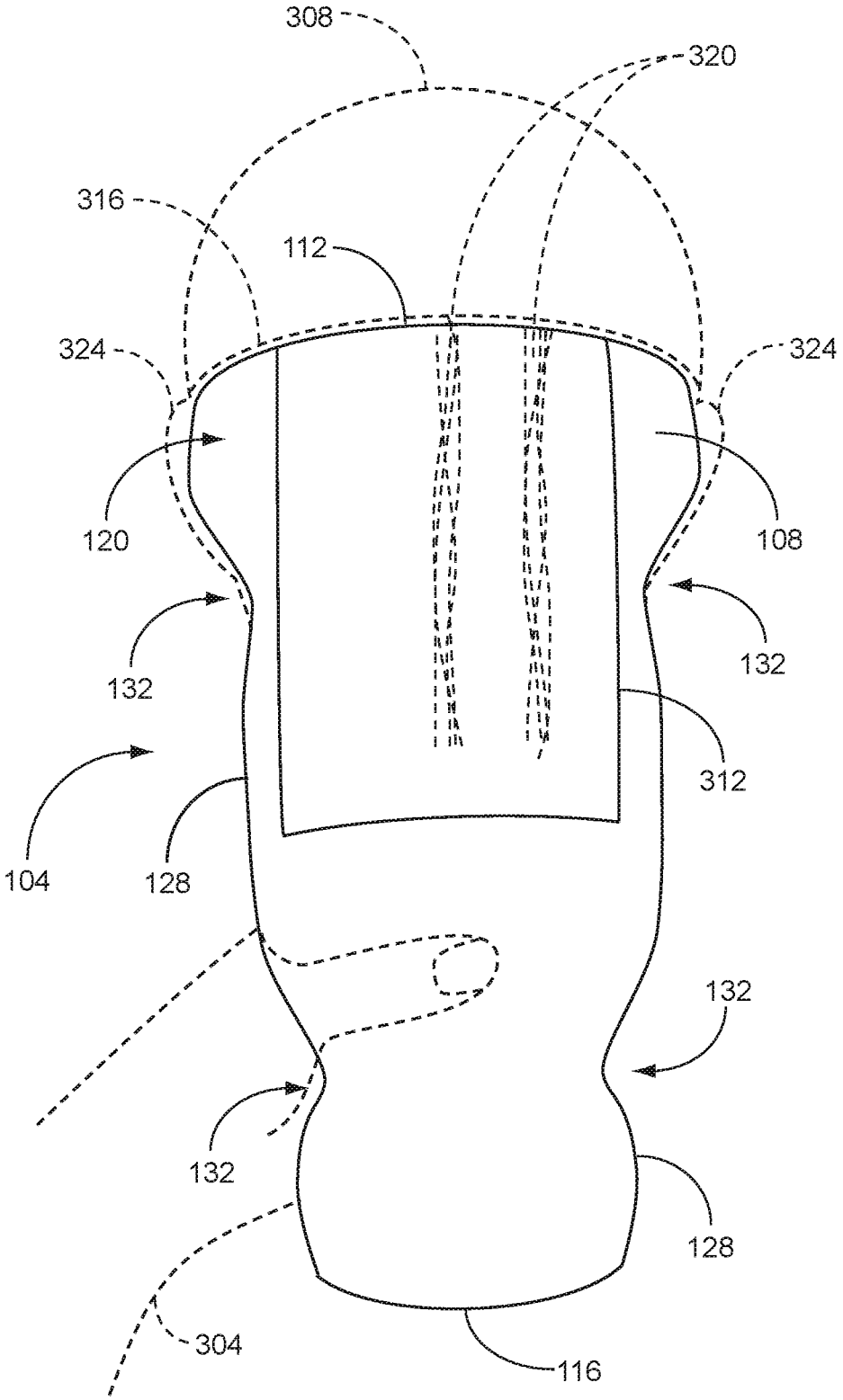
FIG. 3 is a perspective view of an exemplary hair painting board in use.

The hair painting board 104 may also have contoured sides 128. Referring to FIG. 1 for example, it can be seen that the sides 128 of the hair painting board 104 may have one or more notches 132, forming first and second pairs of opposing notches. The first pair of opposing notches is located proximate the wider front end 112 and the second pair of opposing notches is located proximate the narrower end 116. Notches 132 are advantageous in that they permit a hair stylist to easily grasp, hold and manipulate the haft painting board 140, such as can be seen in FIG. 3. Each of contoured sides 128 has an angled portion disposed between the wide front end 112 and a corresponding notch 132 of the first pair of opposing notches, and the angled portions have a first end adjacent the wide end 112 of the planar body and an opposing second end adjacent the corresponding notch, where each the angle portion taper from its second end toward its first end such that a maximum width of the planar body is defined at the angled portion. A minimum width of the planar body is defined by the second pair of opposing notches. The planar body also includes an intermediary section disposed between the first and second pairs of opposing notches. The intermediary section is wider than the narrower end 116 of the planar body and narrower than the wide end 112 of the planar body. Typically, the sides 128 of the hair painting board 104 will be symmetrical, such as shown. In some embodiments, each side 128 may be distinct however.

FIG. 3 illustrates an exemplary hair painting board 104 in use. As can be seen, a hair stylist may hold the hair painting board 104 in their hand 304, such as at one or more notches 132. The hair stylist may position an end 112, 116 of the hair painting board 104 adjacent a client's scalp 308. It is contemplated that the hair painting board 104 (or other tool) may be used to part a client's hair to better access the scalp 308.

As shown in FIG. 3, the hair has been parted along a part 316, and the front end 112 of the hair painting board 104 has been positioned adjacent thereto in a generally vertical orientation. The curved or contoured shape of the hair painting board 104 conforms to the circumference or curve of the scalp 308 and provides access to the hair roots at the part 316, while also forming a barrier for hair below the hair painting board. This helps control application of a coloring compound in that it prevents coloring compound from reaching hair below the hair painting board 104 when the coloring compound is applied.

Foil or another covering 312 may be used to cover the top surface 120 of the hair painting board 104. In this manner, the hair painting board 104 provides a structure or foundation that supports a covering 312. It is contemplated that a covering 312 may be folded over the front end 312, sides 128 or both to help keep the covering in position during use.

Selected hair strands 320 can then be draped over the covering, such as shown. Treatment of hair strands 320 may then take place on the covering 312. Typically, such treatment will comprise painting or brushing a coloring compound onto the hair strands 320. The hair painting board 104 can then be removed leaving the covering 312 and painted hair strands 320 in place. Thereafter, a hair stylist may move to another part 316 and repeat the process to paint other hair strands 320.

Painted hair strands 320 may be left a predefined period of time to allow a coloring compound to take proper effect. It is contemplated that a covering 312 may be folded over the hair strands 320 to cover or enclose the hair strands while this takes place.

As can be seen, the wider front end 112 of the hair painting board 104 can span the majority of a client's scalp 308. In one or more embodiments, the front end 112 may extend from ear 324 to ear. A wide covering 312 can then be applied at the front end 112. This provides a large surface area upon which different individual bundles of hair strands 320 at distinct areas of the scalp 308 may be placed for treatment. Similarly, a narrower rear end 116 of the hair painting board 104 can be used for smaller areas of a client's scalp 308. For example, the circumference of a scalp is smaller near the top of a client's head, and at the sides of the head between the temple and ear. The rear end 116 of the hair painting board may better fit these areas. It is noted that the hair painting board 104 will typically be flexible or resilient to allow it to conform to a variety of different scalps 308. As discussed above, a hair painting board 104 may also be heated and manipulated into various curvatures.

A rear end 116 of the hair painting board 104 may be used similarly to the front end 112. For example, a rear end 116 may have a covering 312 applied thereto and be positioned adjacent a part 316 of a client's hair. One or more hair strands 320 may then be draped over the covering 312. A coloring compound may then be applied to such hair strands 320. The hair painting board 104 may then be removed, leaving the covering 312 and treated hair strands 320 in place to complete the treatment process. A hair stylist may switch between using the front end 112 and rear end 116 of a hair painting board 104 as desired or as dictated by the shape of a client's scalp. Notches 132 at the front end 112 and rear end 116 of the hair painting board 104 aid in holding and manipulating the hair painting board.

Figure 4:
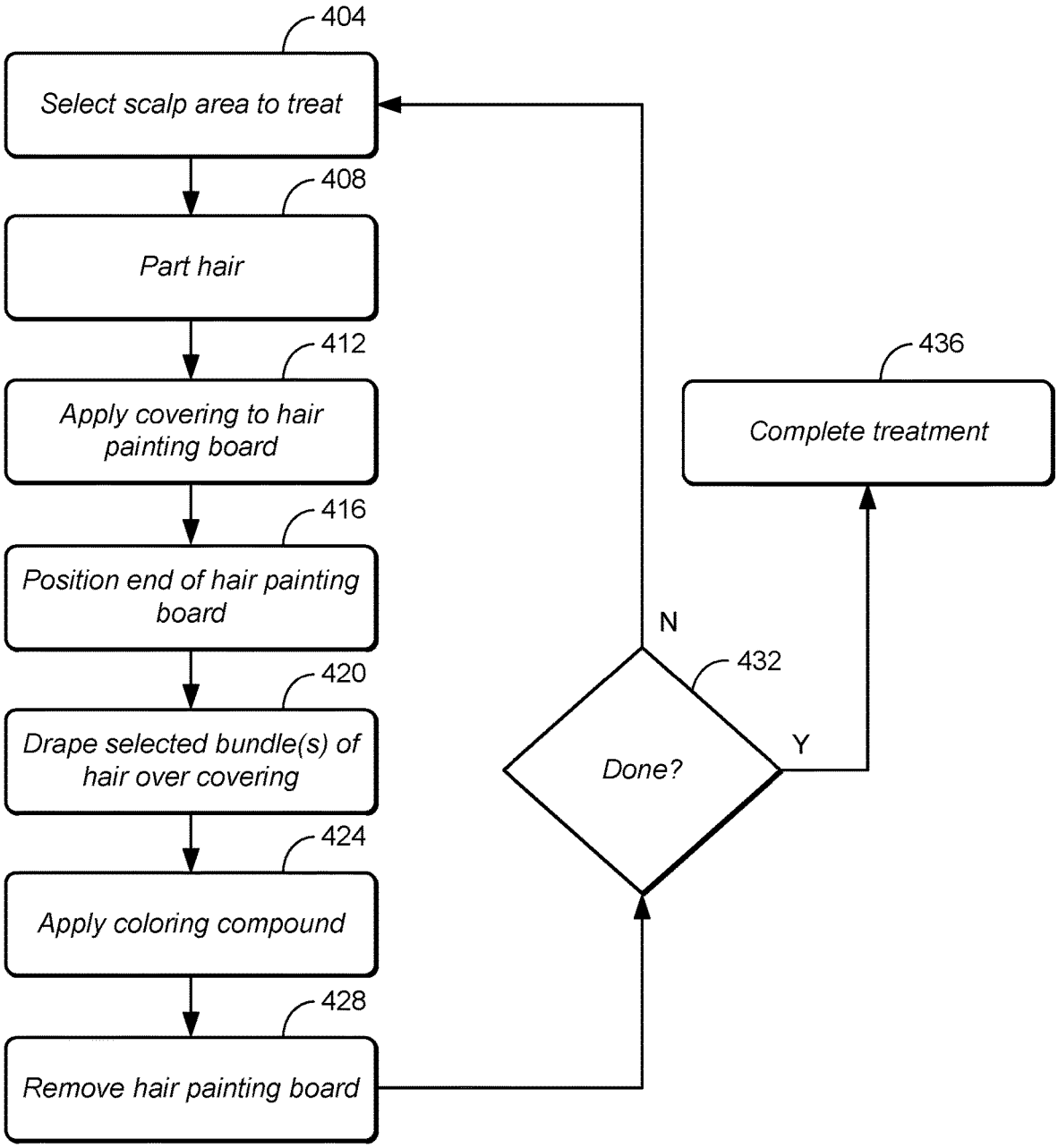
FIG. 4 is a flow diagram illustrating operation of an exemplary hair painting board.

FIG. 4 is a flow diagram illustrating use of an exemplary hair painting board. At a step 404, an area of a scalp may be selected for treatment. At a step 408, a part may be formed at such area. A part may be formed with an end or side of the hair painting board, or with other styling tools (e.g., combs, picks, etc. . . . ). At a step 412, a covering may be applied to an end of the hair painting board. As described above, a covering may be folded over the end, sides or both of the hair painting board to help keep the covering in place. The end where the covering is applied may be selected based on the size of the area to be treated. For instance, a narrower end of the hair painting board will typically be used when narrower areas are to be treated, while a wider end of the hair painting board may be used when wider areas are to be treated At a step 416 the end of the hair painting board may be positioned adjacent or in the part. One or more hair strands or bundles thereof may then be selected from the part and draped over the covering at a step 420. At a step 424, coloring compound may be applied, such as by painting or brushing the coloring compound on the hair strands. It is noted that one or more coloring compounds may be applied. In addition, other hair treatments may be applied as well, if desired.

The hair painting board may then be removed at a step 428, leaving the covering in place. As disclosed above, the covering may be folded to cover or enclose the treated hair strands. At a decision step 432 if the hair stylist is done, the treatment may complete at a step 436. Completion of a treatment may include allowing coloring or other treatment compounds to properly take effect, removal of coverings, rinsing or washing of the client's hair or various subsets thereof.

If the treatment is not done at a step 432 then the process may repeat by returning to step 404 where another area of the scalp may be selected for treatment. As noted above, the front end, rear end or both ends may be used to complete a treatment for a client. For example, the hair painting board may be rotated to apply its front end or rear end to a client's scalp as desired. As disclosed above, the selection of the front end or rear end will typically depend on the width or size of the scalp undergoing treatment.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A hair painting board for applying of a hair treatment at a scalp, the hair painting board comprising:

a planar body having a wide end, a narrower end opposite the wide end and first and second contoured sides extending between the wide and narrower ends, wherein the wide and narrower ends define convexly curved terminal edges;

the planar body is formed from a continuous resilient material and is curved to have a convex top surface and a concave bottom surface;

the first and second contoured sides comprising a first pair of opposing notches located proximate the wide end of the planar body and a second pair of opposing notches located proximate the narrower end of the planar body, wherein each notch of the first and second pairs of opposing notches extends inward into the planar body; and an intermediary section disposed between the first and second pairs of opposing notches, the intermediary section being wider than the narrower end of the planar body and narrower than the wide end of the planar body;

wherein each of the first and second contoured sides includes an angled portion disposed between the wide end and a corresponding notch of the first pair of opposing notches, the angled portion having a first end adjacent the wide end and a second end adjacent the corresponding notch where the angled portion tapers from the second end toward the first end such that a maximum width of the planar body is defined at the angled portion, and a minimum width of the planar body is defined by the second pair of opposing notches;

wherein the planar body is open at the wide end and the narrower end, and during use, the planar body is grasped by fingers placed at one or more notches of the first or second pairs of opposing notches, the concave bottom is placed facing the scalp, and a section of hair is placed on the convex top surface.

2. The hair painting board of claim 1 further comprising a handle at the concave bottom surface.

3. The hair painting board of claim 1, wherein the convex top surface has one or more guides affixed thereon.

4. The hair painting board of claim 1, wherein the curve of the planar body is adjustable to have a second curvature, distinct from that of the curve, after treating the resilient planar material.

5. A hair painting board for applying a hair treatment at a scalp, the hair painting board comprising:

a planar body having a first end, a second end opposite the first end, and first and second contoured sides extending between the first and second ends, wherein the first and second ends define convexly curved terminal edges;

the planar body being bendable and curved to have a convex top surface and a concave bottom surface and the first end of the planar body is wider than the second end of the planar body;

the first and second contoured sides comprise a first pair of opposing notched portions located proximate the first end of the planar body and a second pair of opposing notched portions located proximate the second end of the planar body, wherein each notched portion of the first and second pair of opposing notched portions that extends inward into the planar body; and an intermediary section disposed between the first and second pairs of opposing notched portions, the intermediary section being wider than the second end of the planar body and narrower than the first end of the planar body;

wherein each of the first and second contoured sides includes an angled portion disposed between the first end of the planar body and a corresponding notched portion of the first pair of opposing notched portions, the angled portion having a first end adjacent the first end of the planar body and a second end adjacent the corresponding notched portion where the angled portion tapers from the second end thereof toward the first end thereof such that a maximum width of the planar body is defined at the angled portion, and a minimum width of the planar body is defined by the second pair of opposing notched portions; and wherein the planar body is open at its first and second ends, and during use, the planar body is grasped between fingers placed at one or more notched portions of the first or second pairs of opposing notched portions, the concave bottom is placed facing the scalp, and a section of hair is placed on the convex top surface.

6. The hair painting board of claim 5 further comprising a handle at the concave bottom surface.

7. The hair painting board of claim 5, wherein the convex top surface has one or more guides affixed thereon.

8. The hair painting board of claim 5, wherein the curve of the planar body is adjustable to have a second curvature, distinct from that of the curve, after treating the planar body.

9. The hair painting board of claim 5, wherein the planar body is formed from a resilient material.

10. A method for applying hair treatments using the hair painting board of claim 5, the method comprising:

parting hair to form a part;

a grasping the hair painting board at one or more of the first or second pairs of opposing notched portions thereof;

engaging the scalp at the part with the first end or the second end of the hair painting board;

placing a section of hair on a the convex top surface of the hair painting board; and applying one or more compounds to the section of hair.

11. The method of claim 10 further comprising applying a covering to the first end of the hair painting board before engaging the scalp at the part.

12. The method of claim 10 further comprising applying a covering to the second end of the hair painting board before engaging the scalp at the part.

13. The method of claim 10 further comprising forming a second part in the hair and engaging the scalp at the second part with the first end or the second end of the hair painting board.

14. The method of claim 10 wherein the step of grasping the hair painting board is achieved by grasping a handle extending from the concave bottom surface of the hair painting board.

15. The method of claim 10 further comprising altering a curve of the curved planar body after heating the planar body.

* * * * *